US010590931B2

(12) United States Patent
Park et al.

(10) Patent No.: US 10,590,931 B2
(45) Date of Patent: Mar. 17, 2020

(54) SCROLL COMPRESSOR AND AIR CONDITIONER HAVING THE SAME

(71) Applicant: LG Electronics Inc., Seoul (KR)

(72) Inventors: Hansaem Park, Seoul (KR); Soojin Kang, Seoul (KR); Kangwook Lee, Seoul (KR); Hojong Jeong, Seoul (KR); Cheolhwan Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 75 days.

(21) Appl. No.: 16/016,303

(22) Filed: Jun. 22, 2018

(65) Prior Publication Data

US 2018/0372100 A1 Dec. 27, 2018

(30) Foreign Application Priority Data

Jun. 22, 2017 (KR) ..... 10-2017-0078851

(51) Int. Cl.
*F04C 18/02* (2006.01)
*F04C 29/00* (2006.01)
(Continued)

(52) U.S. Cl.
CPC ..... *F04C 18/0215* (2013.01); *F04C 18/0261* (2013.01); *F04C 18/0292* (2013.01);
(Continued)

(58) Field of Classification Search
CPC .. F04C 18/0215; F04C 18/0292; F04C 29/12; F04C 23/008; F04C 18/0261;
(Continued)

(56) References Cited

U.S. PATENT DOCUMENTS

2012/0258004 A1* 10/2012 Ignatiev ..... F04C 18/0215 418/55.2
2013/0081424 A1* 4/2013 Jang ..... F04C 18/0292 62/498
2016/0201954 A1* 7/2016 Ryu ..... F25B 1/04 62/325

FOREIGN PATENT DOCUMENTS

DE 102011010003 8/2011
DE 112015001018 12/2016
(Continued)

OTHER PUBLICATIONS

European Search Report in European Application No. 18178417.4, dated Oct. 29, 2018, 7 pages.

*Primary Examiner* — Emmanuel E Duke
(74) *Attorney, Agent, or Firm* — Fish & Richardson P.C.

(57) ABSTRACT

A scroll compressor according to the present disclosure and an air conditioner having the scroll compressor may include a drive motor provided in an inner space of a casing; a rotation shaft coupled to the drive motor; a frame provided on a lower side of the drive motor; a first scroll provided on a lower side of the frame, one side of which is formed with a first wrap; a second scroll in which a second wrap engaged with the first wrap is formed, and the rotation shaft is eccentrically coupled to the second wrap to overlap therewith in a radial direction, a compression chamber is formed between the first scroll and the second scroll while being orbitally moved with respect to the first scroll, and the compression chamber is connected to an evaporator outlet side of the cooling cycle; and an injection unit one end of which is branched from a refrigerant pipe between the condenser and the evaporator, and the other end of which is connected to the compression chamber through the first scroll.

15 Claims, 12 Drawing Sheets

(51) Int. Cl.

| | |
|---|---|
| ***F04C 29/04*** | (2006.01) |
| ***F04C 23/00*** | (2006.01) |
| ***F04C 29/12*** | (2006.01) |
| ***F04C 29/02*** | (2006.01) |
| ***F25B 1/04*** | (2006.01) |

(52) U.S. Cl.
CPC ..... *F04C 23/008* (2013.01); *F04C 29/0007* (2013.01); *F04C 29/02* (2013.01); *F04C 29/042* (2013.01); *F04C 29/12* (2013.01); *F25B 1/04* (2013.01); *F04C 2210/26* (2013.01); *F04C 2240/30* (2013.01); *F04C 2240/40* (2013.01); *F04C 2240/60* (2013.01)

(58) Field of Classification Search
CPC .... F04C 29/042; F04C 29/02; F04C 29/0007; F04C 2240/60; F04C 2240/40; F04C 2240/30; F04C 2210/26; F25B 1/04
See application file for complete search history.

(56) References Cited

FOREIGN PATENT DOCUMENTS

| | | | | |
|---|---|---|---|---|
| EP | 3043125 | | 7/2016 | |
| JP | 2008215697 | | 9/2008 | |
| JP | 2016108991 A | * | 6/2016 | ..... F04C 29/042 |
| KR | 1020100096791 | | 9/2010 | |
| KR | 1020160018166 | | 2/2016 | |
| KR | 1020160086654 | | 7/2016 | |
| WO | 2016088342 | | 6/2016 | |

* cited by examiner

SCROLL COMPRESSOR AND AIR CONDITIONER HAVING THE SAME

CROSS-REFERENCE TO RELATED APPLICATIONS

The present disclosure relates to subject matter contained in priority Korean Application No. 10-2017-0078851, filed on Jun. 22, 2017, which are herein expressly incorporated by reference in their entirety.

BACKGROUND OF THE INVENTION

1. Field of the Invention

The present disclosure relates to a scroll compressor and an air conditioner having the same, and more particularly, to a scroll compressor having a compression unit located at a lower side of an electric motor unit and an air conditioner having the same.

2. Description of the Related Art

An air conditioner is a home appliance for maintaining indoor air in a state suitable for its use and purpose. Such an air conditioner is driven by a cooling cycle for compressing, condensing, expanding and evaporating refrigerant, thereby performing a cooling or heating operation in an indoor space. Such an air conditioner may be divided into a separate air conditioner in which an indoor unit and an outdoor unit are separated from each other and an integrated air conditioner in which the indoor unit and the outdoor unit are combined into one unit depending on whether or not the indoor unit and the outdoor unit are separated from each other.

The outdoor unit includes an outdoor heat exchanger that performs heat exchange with outdoor air, and the indoor unit includes an indoor heat exchanger that performs heat exchange with indoor air. The air conditioner may be operated so as to be switchable to a cooling mode or a heating mode. When the air conditioner is operated in a cooling mode, the outdoor heat exchanger functions as a condenser and the indoor heat exchanger functions as an evaporator. On the contrary, when the air conditioner is operated in a heating mode, the outdoor heat exchanger functions as an evaporator and the indoor heat exchanger functions as a condenser.

Typically, when the outdoor air condition is poor, the cooling or heating performance of the air conditioner may be restricted. For example, a sufficient amount of circulation of refrigerant should be secured to obtain desired cooling and heating performance of the air conditioner when the outside temperature of a region in which the air conditioner is installed is very high or very low. For this purpose, when a compressor having a large capacity is provided, there is a problem in which the manufacturing and installation cost of the air conditioner is increased.

In view of this, a part of the refrigerant discharged from the compressor may be bypassed in the middle of the refrigeration cycle and injected into the middle of the compression chamber without increasing the capacity of the compressor. This is referred to as an injection cycle, and an air conditioner to which such an injection cycle is applied and a scroll compressor applied to the injection cycle type air conditioner are known.

As is known, a scroll compressor is a compressor that forms a compression chamber consisting of a suction chamber, an intermediate pressure chamber, and a discharge chamber between two scrolls when a plurality of scrolls perform a relative orbiting motion while being engaged with each other. The scroll compressor may obtain a stable torque due to suction, compression, and discharge strokes of the refrigerant being smoothly carried out while obtaining a relatively high compression ratio as compared with other types of compressors. Therefore, the scroll compressor is widely used for refrigerant compression in air conditioning devices or the like. In recent years, a high-efficiency scroll compressor having a reduced eccentric load at an operation speed above 180 Hz has been introduced.

A scroll compressor may be divided into a low-pressure type in which the suction pipe communicates with an inner space of the casing constituting a low-pressure portion, and a high-pressure type in which the suction pipe directly communicates with the compression chamber. Accordingly, the driving unit is provided in the suction space, which is a low-pressure portion, for the low-pressure type, while the driving unit is provided in the discharge space, which is a high-pressure portion, for the low-pressure type.

Such a scroll compressor may be divided into an upper compression type and a lower compression type according to the positions of the driving unit and the compression unit, and it is referred to as an upper compression type when the compression unit is located above the driving unit, and a lower compression type when the compression unit is located below the driving unit.

The scroll compressor receives a gas force in a direction that the orbiting scroll moves away from the fixed scroll (or including the non-orbiting scroll capable of moving up and down) while the pressure of the compression chamber usually rises. Then, as the orbiting scroll moves away from the fixed scroll, a leakage occurs between the compression chambers to increase compression loss.

In view of this, in a scroll compressor, a tip chamber method in which a sealing member is inserted into a front end surface of the fixed wrap and the orbiting wrap is applied, or a back pressure method in which a back pressure chamber making an intermediate pressure or discharge pressure is formed on a rear surface of the orbiting scroll or the fixed scroll to pressurize the orbiting scroll or the fixed scroll to the counterpart scroll by the pressure of the back pressure chamber.

As described above, there are prior arts related to a scroll compressor and an air conditioner applied to an injection cycle, such as Korean Patent Publication No. 10-2010-0096791 (Scroll compressor and cooling apparatus using the same) and Korean Patent No. 101382007 (Scroll compressor and air conditioner including the same) applied to an injection cycle.

However, all of these prior arts are applied to an upper compression scroll compressor, and there is a problem that the structure of the compressor itself is complicated, and oil feeding according to the operation speed of the compressor is not constant and the manufacturing cost is excessively high.

In addition, the upper compression scroll compressor has a structure in which the injected refrigerant is injected from an upper side to a lower side of the compression chamber, and thus there is a limitation in blocking liquid refrigerant from flowing into the compression chamber. In other words, the upper compression scroll compressor is provided with a main frame at a lower portion thereof, and a fixed scroll is provided at an upper side of the main frame, and an orbiting scroll is disposed between the main frame and the fixed scroll. Therefore, when an injection hole is formed in the main frame, the injection hole must pass through an end plate of the orbiting scroll, which may not be a practical structure. Accordingly, the injection hole is generally formed so as to pass through the fixed scroll forming an upper side of the compression chamber. However, when the injection hole is penetrated from an upper side of the compression chamber, gas refrigerant and liquid refrigerant are injected together into the compression chamber during the process of injecting the refrigerant into the compression chamber through the injection hole, thereby causing compression loss.

SUMMARY OF THE INVENTION

An object of the present disclosure is to provide a scroll compressor capable of simplifying the structure of the compressor to reduce the manufacturing cost of a cooling cycle to which the compressor is applied as well as the compressor, and an air conditioner having the same.

Furthermore, another object of the present disclosure is to provide a scroll compressor capable of enhancing lubrication performance irrespective of the operation speed of the compressor to enhance the performance of a cooling cycle to which the compressor is applied as well as the compressor, and an air conditioner having the same.

In addition, still another object of the present disclosure is to provide a scroll compressor capable of effectively suppressing liquid refrigerant from flowing into an intermediate pressure chamber of the compressor applied to an injection cycle, and an air conditioner having the same.

In order to accomplish the objectives of the present disclosure, there is provided a scroll compressor, including a casing an inner space of which is communicably coupled to a discharge pipe connected to a condenser inlet side of a cooling cycle device; a drive motor provided in an inner space of the casing; a rotation shaft coupled to the drive motor; a frame provided on a lower side of the drive motor; a first scroll provided on a lower side of the frame, one side of which is formed with a first wrap; a second scroll in which a second wrap engaged with the first wrap is formed, and the rotation shaft is eccentrically coupled to the second wrap to overlap therewith in a radial direction, a compression chamber is formed between the first scroll and the second scroll while being orbitally moved with respect to the first scroll, and the compression chamber is connected to an evaporator outlet side of the cooling cycle; and an injection unit one end of which is branched from a refrigerant pipe between the condenser and the evaporator, and the other end of which is connected to the compression chamber through the first scroll.

Here, the injection unit may include an injection pipe one end of which is branched from a refrigerant pipe between the condenser and the evaporator, and the other end of which is penetrated and coupled to the casing; and an injection passage connected to the other end of the injection pipe and communicated with the compression chamber through an inside of the first scroll.

Furthermore, the injection passage may include a first passage formed toward the center from an outer circumferential surface of the first scroll; and a second passage one end of which is connected to the first passage and the other end of which is communicated with the compression chamber.

Furthermore, a bypass hole for discharging refrigerant compressed in the compression chamber prior to the final compression chamber may be formed in the first scroll, and an outlet of the injection unit may be communicated with another compression chamber having a pressure lower than a compression chamber communicating with the bypass hole.

Furthermore, a back pressure chamber may be formed between the frame and the second scroll, and an oil feeding path communicating between the back pressure chamber and the compression chamber may be formed in the first scroll, and an outlet of the injection unit may be communicated with another compression chamber having a pressure lower than a compression chamber communicating with the oil feeding path.

Furthermore, an outlet of the injection unit may be communicated with a compression chamber formed in a compression chamber subsequent to the suction completion of refrigerant being sucked into the compression chamber.

Furthermore, the injection unit may include a plurality of injection units, and the plurality of injection units may be formed at different angles with respect to a rotation angle of the rotation axis.

Furthermore, the plurality of injection units may communicate with compression chambers having different pressures, respectively.

Furthermore, the plurality of injection units may include a first injection unit and a second injection unit, and the first injection unit may be communicated with a compression chamber prior to the suction completion of refrigerant being sucked into the compression chamber, and the second injection unit may be communicated with a compression chamber subsequent to the suction completion of refrigerant being sucked into the compression chamber.

In addition, in order to accomplish the objectives of the present disclosure, there is provided a scroll compressor, including a casing an inner space of which is communicably coupled to a discharge pipe connected to a condenser inlet side of a cooling cycle device; a drive motor provided in an inner space of the casing; a rotation shaft coupled to the drive motor; a frame provided on a lower side of the drive motor; a first scroll provided on a lower side of the frame, one side of which is formed with a first wrap; a second scroll in which a second wrap engaged with the first wrap is formed, and a compression chamber is formed between the first scroll and the second scroll while being orbitally moved with respect to the first scroll, and the compression chamber is connected to an evaporator outlet side of the cooling cycle; and an injection unit one end of which is branched from a refrigerant pipe between the condenser and the evaporator, and the other end of which is connected to the compression chamber through the first scroll.

Moreover, in order to accomplish the objectives of the present disclosure, there is provided an air conditioner, including a condensing unit; a first expansion unit connected to an outlet of the condensing unit; an injection heat exchange unit connected to an outlet of the first expansion unit; a second expansion unit connected to an outlet of the injection heat exchange unit; an evaporation unit connected to an outlet of the second expansion unit; and a compressor having a suction unit connected to an outlet of the evaporation unit, a discharge unit connected to an inlet of the condensing unit, and an injection unit connected to an outlet of the injection connection unit, wherein the compressor includes the foregoing scroll compressor.

Here, the air conditioner may further include a refrigerant switching unit configured to switch a flow direction of refrigerant between the discharge unit and the condensing unit of the compressor.

Furthermore, the injection heat exchange unit may include an injection expansion unit; and an internal heat exchange unit configured to exchange heat between refrigerant that has passed through the injection expansion unit and refrigerant that has passed through the first expansion unit.

Furthermore, the injection heat exchange unit may include a plurality of injection heat exchange units connected in series, and the plurality of injection heat exchange units may include the injection expansion unit and the internal heat exchange unit, respectively.

Furthermore, the plurality of injection heat exchange units may communicate with compression chambers having different pressures.

The scroll compressor according to the present disclosure may be configured such that the compression unit composed of two pairs of scrolls is located below the electric motor unit, thereby simplifying the structure of the compressor to reduce the manufacturing cost of a cooling cycle to which the compressor is applied as well as the compressor.

Furthermore, as the compression unit is located below the electric motor unit as described above, the present disclosure may enhance oil feeding performance irrespective of the operation speed of the compressor to enhance the performance of a cooling cycle to which the compressor is applied as well as the compressor In addition, as an injection passage is formed in a scroll constituting a lower surface of the compression chamber even in the foregoing compression unit, liquid refrigerant may be effectively suppressed from flowing into the compression chamber, thereby enhancing an efficiency of the compressor and an efficiency of a cooling cycle having the same.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Hereinafter, a scroll compressor according to the present disclosure and an air conditioner having the same will be described in detail with reference to an embodiment illustrated in the accompanying drawings. For reference, the scroll compressor according to the present disclosure is a lower compression scroll compressor in which a compression unit is positioned below an electric motor unit, and a rotary shaft is overlapped on the same plane as the orbiting wrap. This type of scroll compressor is known to be suitable for applications to cooling cycles under high temperature and high compression ratio conditions.

Figure 1:
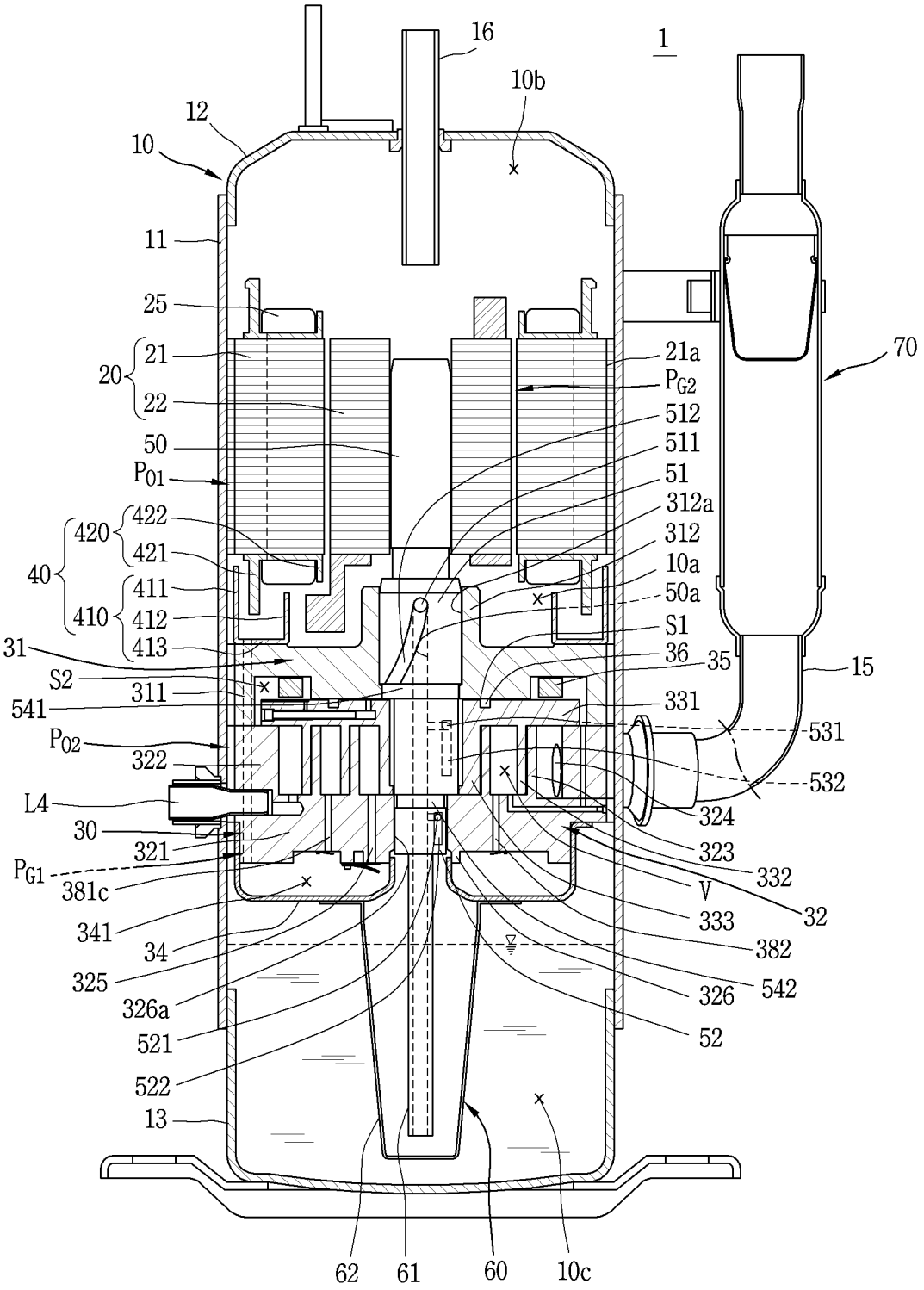
FIG. 1 is a longitudinal cross-sectional view showing a lower compression scroll compressor according to the present disclosure.
Figure 2:
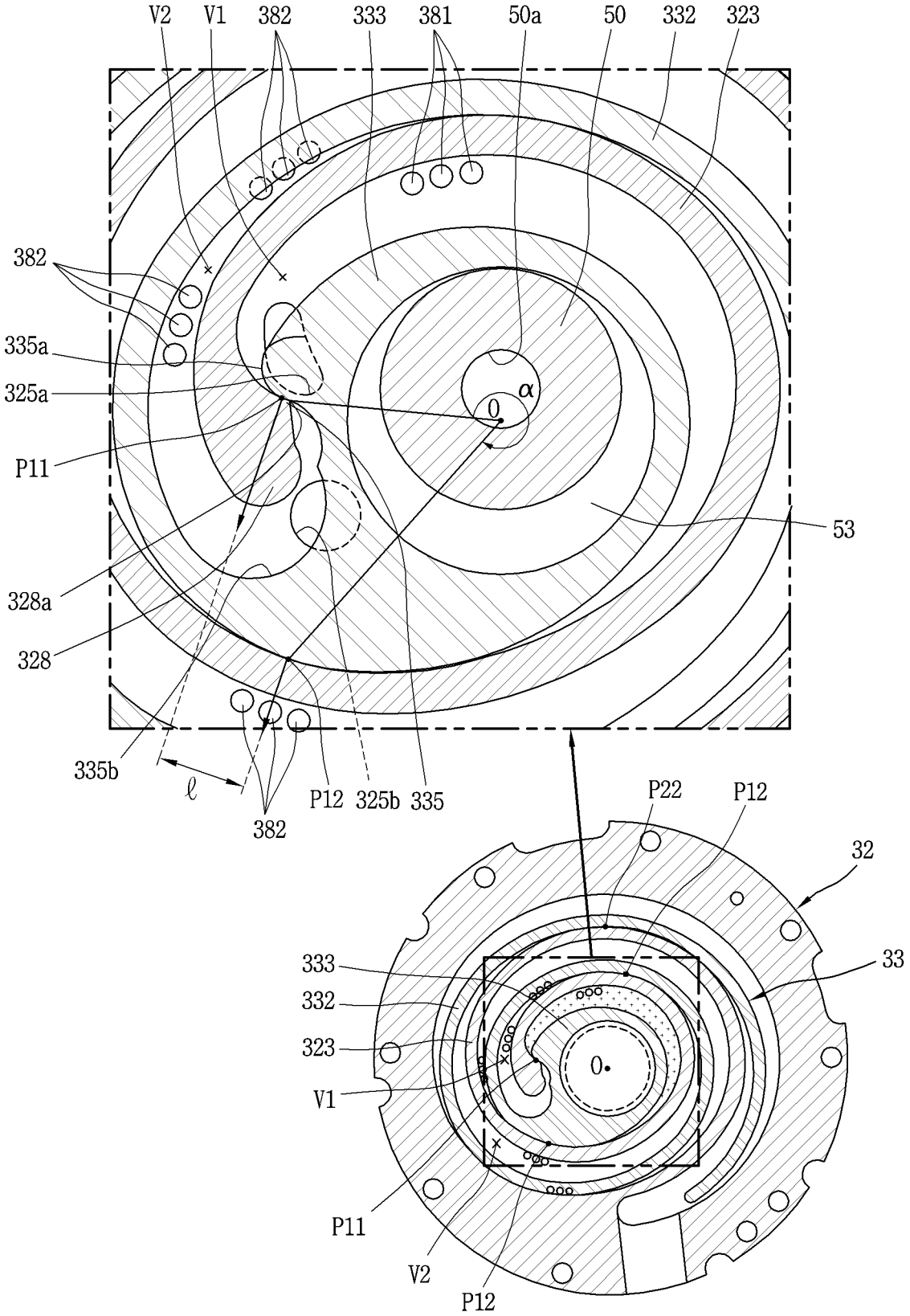
FIG. 2 is a transverse cross-sectional view showing a compression unit in FIG. 1.
Figure 3:
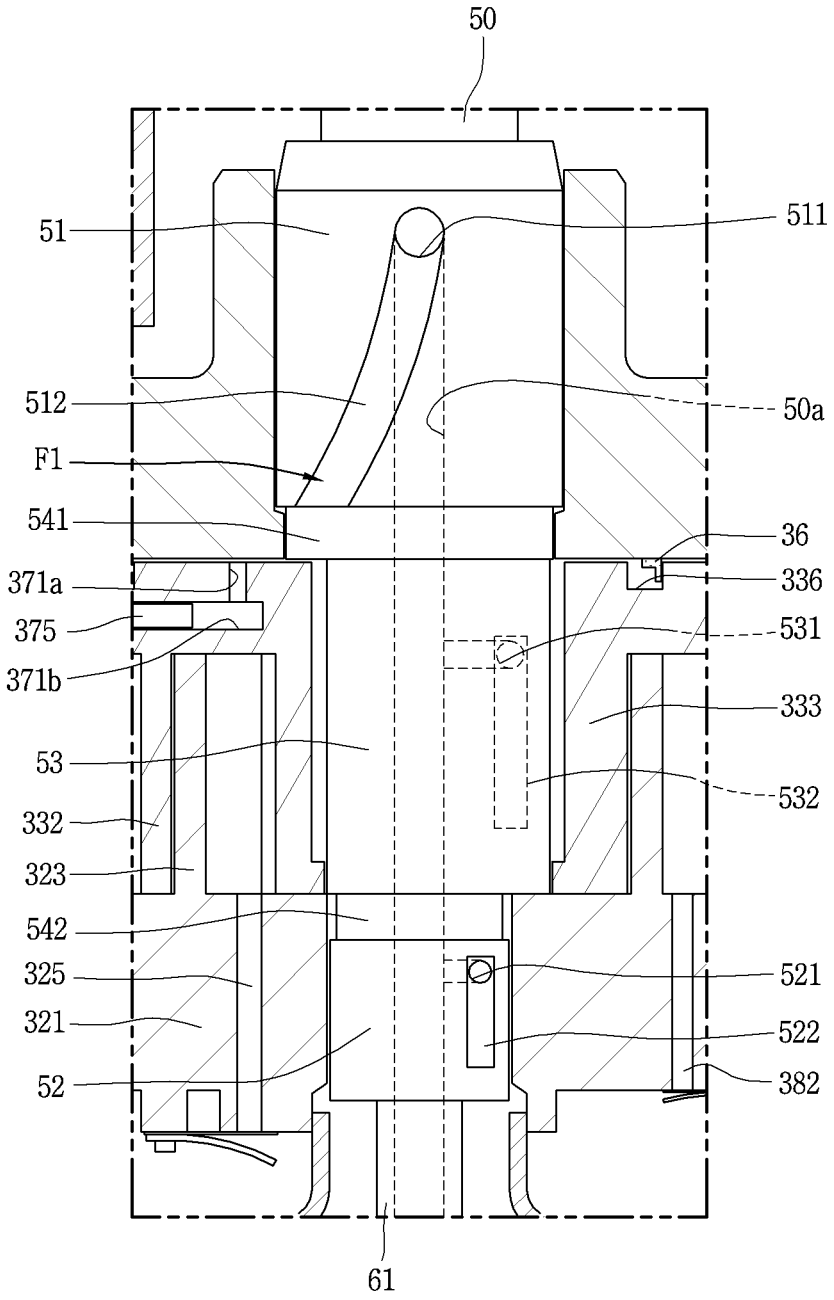
FIG. 3 is a front view showing a part of a rotation shaft for explaining a sliding portion in FIG. 1.
Figure 4:
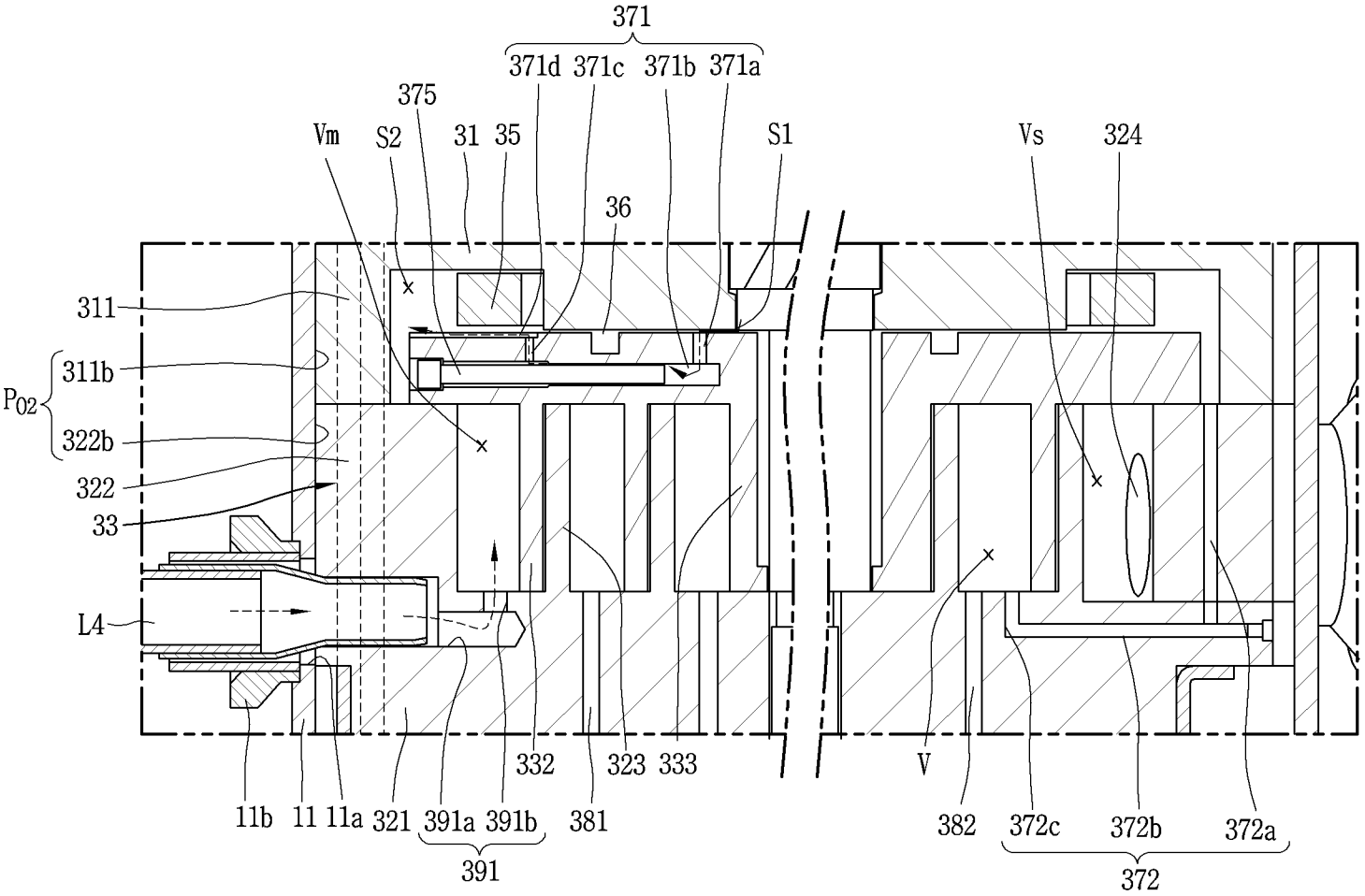
FIG. 4 is a longitudinal cross-sectional view for explaining an oil feeding path and an injection passage between the back pressure chamber and the compression chamber in FIG. 1.

FIG. 1 is a longitudinal cross-sectional view showing a lower compression scroll compressor according to the present disclosure, and FIG. 2 is a transverse cross-sectional view showing a compression unit in FIG. 1, and FIG. 3 is a front view showing a part of a rotation shaft for explaining a sliding portion in FIG. 1, and FIG. 4 is a longitudinal cross-sectional view for explaining an oil feeding path and an injection passage between the back pressure chamber and the compression chamber in FIG. 1.

Referring to FIG. 1, the lower compression scroll compressor 1 according to the present embodiment may be provided with an electric motor unit 20 formed with a drive motor inside a casing 10 to generate a rotational force, and provided with a compression unit 30 disposed at a predetermined space (hereinafter, intermediate space) below the electric motor unit 20 to receive the rotational force of the electric motor unit 20 so as to compress refrigerant.

The casing 10 includes a cylindrical shell 11 constituting a sealed container, an upper shell 12 covering an upper portion of the cylindrical shell 11 to constitute a sealed container together therewith, and a lower shell 13 covering a lower portion of the cylindrical shell 11 to form a storage space 10*c* while constituting a sealed container together therewith.

A refrigerant suction pipe 15 may pass through a side surface of the cylindrical shell 11 to directly communicate with a suction chamber of the compression unit 30, and a refrigerant discharge pipe 16 communicating with an upper space 10*b* of the casing 10 may be provided at an upper portion of the upper shell 12. The refrigerant discharge pipe 16 corresponds to a passage through which compressed refrigerant discharged to an upper space 10*b* of the casing 10 from the compression unit 30 is discharged to the outside, and the refrigerant discharge pipe 16 may be inserted to the middle of the upper space 10*b* of the casing 10 so that the upper space 10*b* can form a type of oil separation space. Furthermore, according to circumstances, an oil separator (not shown) for separating oil mixed into refrigerant may be connected to the refrigerant suction pipe 15 inside the casing 10 including the upper space 10*b* or within the upper space 10*b*.

The electric motor unit 20 includes a stator 21 and a rotor 22 which rotates inside the stator 21. The stator 21 is formed with teeth and slots constituting a plurality of coil winding portions (not shown) on an inner circumferential surface of the stator 21 in a circumferential direction to wind a coil 25, and a gap between an inner circumferential surface of the stator 21 and an outer circumferential surface of the rotor 22 is combined with the coil winding portion to form a second refrigerant passage (PG2). As a result, refrigerant discharged to the intermediate space 10*c* between the electric motor unit 20 and the compression unit 30 through a first refrigerant passage (PG1) which will be described later flows into the upper space 10*b* formed above the electric motor unit 20 through the second refrigerant passage (PG2) formed in the electric motor unit 20.

Moreover, a plurality of D-cut faces 21*a* may be formed on an outer circumferential surface of the stator 21 along an circumferential direction, and a first oil passage (PO1) may be formed between the D-cut faces 21*a* and an inner circumferential surface of the cylindrical shell 11 to allow oil to pass therethrough. As a result, oil separated from refrigerant in the upper space 10*b* moves to the lower space 10*c* through the first oil passage (PO1) and the second oil passage (PO2) which will be described later.

A frame 31 constituting the compression unit 30 may be fixedly coupled to an inner circumferential surface of the casing 10 at a predetermined distance below the stator 21. An outer circumferential surface of the frame 31 may be shrink-fitted or welded and fixedly coupled to an inner circumferential surface of the cylindrical shell 11.

Besides, an annular frame sidewall portion (first sidewall portion) 311 is formed at an edge of the frame 31, and a plurality of communication grooves 311*b* are formed along a circumferential direction on an outer circumferential surface of the first sidewall portion 311. The communication grooves 311*b* together with the communication grooves 322*b* of the first scroll 32 which will be described later form the second oil passage (PO2).

Furthermore, a first shaft receiving portion 312 for supporting a main bearing portion 51 of a rotation shaft 50 which will be described later may be formed at the center of the frame 31, and a first shaft receiving hole 312*a* may be formed in an axial direction in the first shaft receiving portion to pass therethrough such that the main bearing portion 51 of the rotation shaft 50 is rotatably inserted and supported in a radial direction.

In addition, a fixed scroll (hereinafter, referred to as a first scroll) 32 may be provided on a lower surface of the frame 31 with an orbiting scroll (hereinafter, referred to as a second scroll 33) eccentrically coupled to the rotation shaft 50 interposed therebetween. The first scroll 32 may be fixedly coupled to the frame 31, but may also be movable coupled thereto in an axial direction.

On the other hand, for the first scroll 32, a fixed end plate portion (hereinafter, referred to as a first end plate portion) 321 may be formed in a substantially disk shape, and a scroll sidewall portion (hereinafter, referred to as a second sidewall portion) 322 coupled to a lower end of the frame 31 may be formed at an edge of the first end plate portion 321.

A suction port 324 through which the refrigerant suction pipe 15 communicates with the suction chamber may be formed in a penetrating manner at one side of the second sidewall portion 322, and a discharge port 325 communicated with the discharge chamber to discharge compressed refrigerant may be formed at the center of the first end plate portion 321. Only one discharge port 325 may be formed to communicate with both a first compression chamber (V1) and a second compression chamber (V2) which will be described later, but a first discharge port 325*a* and a second discharge port 325*b* may be formed to communicate independently the first compression chamber (V1) and the second compression chamber (V2).

Furthermore, the communication groove 322*b* described above is formed on an outer circumferential surface of the second sidewall portion 322, and the communication groove 322*b* forms the second oil passage (PO2) for guiding oil collected together with the communication groove 311*b* of the first sidewall portion 311 to the lower space 10*c*.

In addition, a discharge cover 34 for guiding refrigerant discharged from the compression chamber (V) to a refrigerant passage which will be described later may be coupled to a lower side of the first scroll 32. An inner space of the discharge cover 34 may be formed to receive the discharge ports 325*a*, 325*b* while receiving an inlet of the first refrigerant passage (PG1) for guiding refrigerant discharged from the compression chamber (V) through the discharge ports 325*a*, 325*b* to the upper space 10*b* of the casing 10, more precisely, to a space between the electric motor unit 20 and the compression unit 30.

Here, the first refrigerant passage (PG1) may be formed by sequentially passing through the second sidewall portion 322 of the fixed scroll 32 and the first sidewall portion 311 of the frame 31 from an inner side of the passage separation unit 40, that is, a side of the rotation shaft 50 on an inner side with respect to the passage separation unit 40. As a result, the second oil passage (PO2) described above is formed outside the passage separation unit 40 so as to communicate with the first oil passage (PO1).

Furthermore, a fixed wrap (hereinafter, referred to as a first wrap) 323 engaged with an orbiting wrap (hereinafter, referred to as a second wrap) 332 to form a compression chamber (V) may be formed on an upper surface of the first end plate portion 321. The first wrap 323 will be described later with the second wrap 332.

In addition, a second shaft receiving portion 326 for supporting a sub-bearing portion 52 of the rotation shaft 50 which will be described later may be formed at the center of the first end plate portion 321, and the second bearing portion 326 may be formed with a second shaft receiving hole 326*a* passing therethrough in an axial direction to support the sub-bearing portion 52 in a radial direction.

Moreover, a bypass hole 381 for bypassing part of refrigerant to be compressed in advance is formed in the first end plate portion 321, and a bypass valve 385 is provided at the outlet end of the bypass hole 381. At least one or more bypass holes 381 may be formed at appropriate positions along the advancing direction of the compression chamber (V) to be positioned between the suction chamber and the discharge chamber. Besides, an interval between the bypass holes 381 may be formed to be smaller toward the discharge side in the compression chamber (V2) having a large compression gradient.

On the other hand, for the second scroll 33, an orbiting plate portion (hereinafter, referred to as a second plate portion) 331 may be formed in a substantially circular plate shape. A second wrap 332 engaged with the first wrap 322 to form a compression chamber may be formed on a lower surface of the second end plate 331.

The second wrap 332 may be formed in an involute shape together with the first wrap 323, but may be formed in various other shapes. For example, as shown in FIG. 2, the second wrap 332 may have a shape in which a plurality of arcs having different diameters and origin points are connected to each other, and an outermost curve may be formed in a substantially elliptical shape having a major axis and a minor axis. The first wrap 323 may be formed in the same manner.

A rotation axis coupling portion 333 which forms an inner end portion of the second wrap 332 and to which an eccentric portion 53 of the rotation shaft 50 which will be described later is rotatably inserted and coupled may be formed in an axially penetrating manner at a central portion of the second end plate portion 331.

An outer circumferential portion of the rotation shaft coupling portion 333 is connected to the second wrap 332 to form the compression chamber (V) together with the first wrap 322 during the compression process.

Furthermore, the rotation shaft coupling portion 333 may be formed to have a height that overlaps with the second wraps 332 on the same plane, and disposed at a height where the eccentric portion 53 of the rotation axis 50 overlaps with the second wraps 332 on the same plane. Through this, the repulsive force and the compressive force of the refrigerant are canceled each other while being applied to the same plane with respect to the second end plate portion, thereby preventing an inclination of the second scroll 33 due to an action of the compressive force and the repulsive force.

Furthermore, the rotation shaft coupling portion 333 is formed with a concave portion 335 to be engaged with a protrusion portion 328 of the first wrap 323 which will be described later in an outer circumferential portion opposed to an inner end portion of the first wrap 323. One side of this concave portion 335 is formed with an increasing portion 335*a* for increasing a thickness from an inner circumferential portion to an outer circumferential portion of the rotation shaft coupling portion 333 on an upstream side along the direction of forming the compression chamber (V). It may increase a compression path of the first compression chamber (V1) immediately before discharge, thereby increasing a compression ratio of the first compression chamber (V1) to be close to that of the second compression chamber (V2) as a result. The first compression chamber (V1) is a compression chamber formed between an inner surface of the first wrap 323 and an outer surface of the second wrap 332, which will be described later, separately from the second compression chamber (V2).

The other side of the concave portion 335 is formed with an arc compression surface 335*b* having an arc shape. A diameter of the arc compression surface 335*b* is determined by a thickness of an inner end portion of the first wrap 323 (i.e., a thickness of the discharge end) and an orbiting radius of the second wrap 332, and thus the diameter of the arc compression surface 335*b* increases when increasing the thickness of the inner end portion of the first wrap 323. As a result, the thickness of the second wrap around the arc compression surface 335*b* may also increase to secure durability, and a compression path may be lengthened to increase a compression ratio of the second compression chamber (V2) accordingly.

Furthermore, a protrusion portion 328 protruded toward an outer circumferential portion of the rotation shaft coupling portion 333 may be formed adjacent to an inner end portion (suction end or start end) of the first wrap 323 corresponding to the rotation shaft coupling portion 333, and a contact portion 328*a* protruded from the protrusion portion and engaged with the concave portion 335 may be formed on the protrusion portion 328. In other words, the inner end portion of the first wrap 323 may be formed to have a larger thickness than the other portions. Therefore, a wrap strength of the inner end portion that receives the greatest compressive force on the first wrap 323 is improved to improve durability.

On the other hand, the compression chamber (V) may be formed between the first end plate portion 321 and the first wrap 323, and between the second wrap 332 and the second end plate portion 331, and a suction chamber, an intermediate pressure chamber, and a discharge chamber may be consecutively formed according to an advancing direction of the wrap.

As shown in FIG. 2, the compression chamber (V) includes a first compression chamber (V1) formed between an inner surface of the first wrap 323 and an outer surface of the second wrap 332, and a second compression chamber (V2) formed between an outer surface of the first wrap 323 and an inner surface of the second wrap 332.

In other words, the first compression chamber (V1) includes a compression chamber formed between two contact points (P11, P12) formed by the inner surface of the first wrap 323 and the outer surface of the second wrap 332 being in contact with each other, and the second compression chamber (V2) includes a compression chamber formed between two contact points (P21, P22) formed by the outer surface of the first wrap 323 and the inner surface of the second wrap 332 being in contact with each other.

Here, when an angle having a large value between angles formed by two lines connecting the center of the eccentric portion, that is, the center (O) of the rotation shaft coupling portion, and the two contact points (P11, P12) is $\alpha$, the first compression chamber (V1) immediately before discharge has $\alpha<360°$ immediately before at least the start of discharge, and a distance (I) between normal vectors at the two contact points (P11, P12) also has a value larger than zero.

Due to this, the first compression chamber immediately before discharge may have a smaller volume than the case where the first compression chamber has the fixed wrap and the orbiting wrap made of an involute curve, and thus it may be possible to improve both a compression ratio of the first compression chamber (V1) and a compression ratio of the second compression chamber (V2).

On the other hand, as described above, the second scroll 33 may be orbitably installed between the frame 31 and the fixed scroll 32. Furthermore, an oldham ring 35 for preventing the rotation of the second scroll 33 may be provided between an upper surface of the second scroll 33 and a lower surface of the frame 31 corresponding thereto, and a sealing member 36 forming a back pressure chamber (S1) which will be described later may be provided on an inner side of the oldham ring 35.

Furthermore, an intermediate pressure space is formed by the oil feeding hole 321*a* provided in the second scroll 32 on an outer side of the sealing member 36. The intermediate pressure space communicates with the intermediate pressure chamber (V) to function as a back pressure chamber as the intermediate pressure refrigerant is filled. Therefore, the back pressure chamber formed on the inner side around the sealing member 36 may be referred to as a first back pressure chamber (S1), and the intermediate pressure space formed on the outside may be referred to as a second back pressure chamber (S2). As a result, the back pressure chamber (S1) is a space formed by a lower surface of the frame 31 and an upper surface of the second scroll 33 around the sealing member 36, and the back pressure chamber (S1) will be described again together with a sealing member which will be described later.

On the other hand, the passage separation unit 40 is provided in an intermediate space 10*a* which is a through space formed between a lower surface of the electric motor unit 20 and an upper surface of the compression unit 30 to perform the role of preventing refrigerant discharged from the compression unit 30 from interfering with oil moving from an upper space 10*b* of the electric motor unit 20, which is an oil separation space, to a lower space 10*c* of the compression unit 30, which is an oil storage space.

To this end, the passage separation unit 40 according to the present embodiment includes a passage guide for dividing a space 10*a* into a space through which refrigerant flows (hereinafter, referred to as a refrigerant flow space) and a space through which oil flows (hereinafter, referred to as an oil flow space). Though the passage guide is able to divide the first space 10*a* into the refrigerant flow space and the oil flow space by the passage guide alone, in some cases, a plurality of passage guides may be combined to serve as the passage guide.

The passage separation unit according to the present embodiment includes a first passage guide 410 provided on the frame 31 to extend upward and a second passage guide 420 provided on the stator 21 to extend downward. The first passage guide 410 and the second passage guide 420 are overlapped in an axial direction such that the intermediate space 10*a* can be divided into the refrigerant flow space and the oil flow space.

Here, the first passage guide 410 may be formed in an annular shape and fixedly coupled to an upper surface of the frame 31, and the second passage guide 420 may be inserted into the stator 21 to extend from an insulator insulating a winding coil.

The first passage guide 410 includes a first annular wall portion 411 extended upward from the outside, a second annular wall portion 412 extended upward from the inside, and an annular surface portion 413 extended in a radial direction to connect between the first annular wall portion 411 and the second annular wall portion 412. The first annular wall portion 411 may be formed higher than the second annular wall portion 412, and a refrigerant through hole may be formed on the annular surface portion 413 to communicate with a refrigerant hole communicating to the intermediate space 10*a* from the compression unit 30.

Furthermore, a first balance weight 261 is located at an inner side the second annular wall portion 412, that is, in a direction of the rotation shaft, and the first balance weight 261 is coupled to the rotor 22 or the rotation shaft 50 to rotate. At this time, though the first balance weight 261 can stir refrigerant while rotating, the present disclosure may prevent refrigerant from moving toward the first balance weight 261 by the second annular wall portion 412 to suppress the refrigerant from being stirred by the first balance weight 261.

The second passage guide 420 may include a first extension portion 421 extended downward from an outside of the insulator and a second extension portion 422 extended downward from an inside of the insulator. The first extension portion 421 is formed to overlap with the first annular wall portion 411 in an axial direction to perform the role of dividing the space into the refrigerant flow space and the oil flow space. The second extension portion 422 may not be formed as the need arises, but may not be overlapped with the second annular wall portion 412 in an axial direction even when formed or preferably formed at a sufficient distance in a radial direction to sufficiently flow refrigerant even when overlapped.

On the other hand, the upper portion of the rotation shaft 50 may be press-fitted to the center of the rotor 22 while the lower portion thereof is coupled to the compression unit 30 to be supported in a radial direction. As a result, the rotation shaft 50 transmits a rotational force of the electric motor unit 20 to the orbiting scroll 33 of the compression unit 30. Then, the second scroll 33 eccentrically coupled to the rotation shaft 50 performs an orbiting motion with respect to the first scroll 32.

A main bearing portion (hereinafter, referred to as a first bearing portion) 51 is formed in a lower half portion of the rotation shaft 50 to be inserted into the first shaft receiving hole 312*a* of the frame 31 and supported in a radial direction, and a sub-bearing portion (hereinafter, referred to as a second bearing portion) 52 may be formed on a lower side of the first bearing portion 51 to be inserted into the second shaft receiving hole 326*a* of the first scroll 32 and supported in a radial direction. Furthermore, the eccentric portion 53 may be formed between the first bearing portion 51 and the second bearing portion 52 to be inserted into the rotation shaft coupling portion 333 and coupled therewith.

The first bearing portion 51 and the second bearing portion 52 are coaxially formed to have the same axial center, and the eccentric portion 53 may be formed eccentrically in a radial direction with respect to the first bearing portion 51 or the second bearing portion 52. The second bearing portion 52 may be formed to be eccentric with respect to the first bearing portion 51.

An outer diameter of the eccentric portion 53 should be formed to be smaller than that of the first bearing portion 51 but larger than that of the second bearing portion 52, and it may be advantageous to allow the rotation shaft 50 to pass through the shaft receiving holes 312*a*, 326*a* and the rotation shaft coupling portion 333, respectively, and be coupled thereto. However, in the case where the eccentric portion 53 is not formed integrally with the rotation shaft 50 but formed using a separate bearing, the rotation shaft 50 may be inserted and coupled thereto without forming an outer diameter of the second bearing portion 52 to be smaller than that of the eccentric portion 53.

In addition, an oil supply passage 50*a* for supplying oil to each of the bearing portion and the eccentric portion may be formed along an axial direction within the rotation shaft 50. The oil supply passage 50*a* may be formed by grooving at a lower end of the rotation shaft 50 or a position approximately equal to the lower end or middle height of the stator 21 or higher than an upper end of the first bearing portion 31 as the compression unit 30 is positioned below the electric motor unit 20. Of course, in some cases, it may be formed by passing through the rotation shaft 50 in an axial direction.

Furthermore, an oil feeder 60 for pumping oil filled in the lower space 10*c* may be coupled to a lower end of the rotation shaft 50, that is, a lower end of the second bearing portion 52. The oil feeder 60 includes an oil supply pipe 61 inserted into and coupled to the oil supply passage 50*a* of the rotation shaft 50 and a blocking member 62 for receiving the oil supply pipe 61 to block the intrusion of foreign matter. The oil supply pipe 61 may be positioned to pass through the discharge cover 34 and to be immersed in oil in the lower space 10*c*.

On the other hand, as shown in FIG. 3, a sliding portion oil feeding path (F1) connected to the oil supply passage 50*a* to for supplying oil to each sliding portion is formed in each of the bearing portions 51, 52 and the eccentric portion 53 of the rotation shaft 50.

The sliding portion oil feeding path (F1) has a plurality of oil supply holes 511, 521, 531 penetrating from the oil supply passage 50*a* toward an outer circumferential surface of the rotation shaft 50, and a plurality of oil feeding grooves 512, 522, 532 communicating with the oil feeding holes 511, 521, 531, respectively, to lubricate the bearing portions 51, 52 and the eccentric portion 53, respectively, on an outer circumferential surface of the bearing portions 51, 52 and the eccentric portion 53, respectively.

For example, the first oil feeding hole 511 and the first oil feeding groove 512 are formed in the first bearing portion 51, the second oil feeding hole 521 and the second oil feeding groove 522 in the second bearing portion 52, and the third oil feeding hole 531 and the third oil feeding groove 532 in the eccentric portion 53, respectively. The first oil feeding groove 512, the second oil feeding groove 522, and the third oil feeding groove 532 are formed in an elongated groove shape in an axial direction or inclined direction, respectively.

Moreover, a first connection groove 541 and a second connection groove 542 are formed between the first bearing portion 51 and the eccentric portion 53 and between the eccentric portion 53 and the second bearing portion 52, respectively. A lower end of the first oil feeding groove 512 communicates with the first connection groove 541 and an upper end of the second oil feeding groove 522 is connected to the second connection groove 542. Accordingly, part of oil lubricating the first bearing portion 51 through the first oil feeding groove 512 flows down to be collected into the first connection groove 541, and the oil flows into the first back pressure chamber (S1) to form a discharge pressure of the discharge pressure. Furthermore, oil lubricating the second bearing portion 52 through the second oil feeding groove 522 and oil lubricating the eccentric portion 53 through the third oil feeding groove 532 are collected to the second connection groove 542 to flow into the compression unit 30 through a space between a front end surface of the rotation shaft coupling portion 333 and the first end plate section 321.

In addition, a small amount of oil that is sucked up toward an upper end of the first bearing portion 51 flows out of the bearing surface from an upper end of the first shaft receiving portion 312 of the frame 31 and flows down to an upper surface 31*a* of the frame 31 along the first shaft receiving portion 312, and then collected into the lower space 10*c* through the oil passages (PO1, PO2) continuously formed on an outer circumferential surface of the frame 31 (or a groove communicating from the upper surface to the outer circumferential surface) and an outer circumferential surface of the first scroll 32.

Moreover, oil discharged to the upper space 10*b* of the casing 10 together with refrigerant from the compression chamber (V) is separated from refrigerant in the upper space 10*b* of the casing 10 and collected into the lower space 10*c* through the first oil passage (PO1) formed on an outer circumferential surface of the electric motor unit 20 and the second oil passage (PO2) formed on an outer circumferential surface of the compression unit 30. At this time, a passage separation unit 40 is provided between the electric motor unit 20 and the compression unit 30 to move oil to the lower space 10*c* and refrigerant to the upper space 10*b* through different paths (PO1, PO2, PG1, PG2), respectively, without allowing oil separated from refrigerant in the upper space 10*b* and moved to the lower space 10*c* to be intermixed again with refrigerant discharged from the compression unit 20 and moved to the upper space 10*b*.

On the other hand, the second scroll 33 is formed with a compression chamber oil feeding path (F2) for supplying oil being sucked up through the oil supply passage 50*a* to the compression chamber (V). The compression chamber oil feeding path (F2) is connected to the above-described sliding portion oil feeding path (F1).

The compression chamber oil feeding path (F2) includes a first oil feeding path 371 communicating between the oil feeding passage 50*a* and the second back pressure chamber (S2) forming an intermediate pressure space, and a second oil feeding path 372 communicating with an intermediate pressure chamber between the second back pressure chamber (S2) and the compression chamber (V).

Of course, the compression chamber oil feeding path may be formed to directly communicate with the intermediate pressure chamber from the oil supply passage 50*a* without passing through the second back pressure chamber (S2). However, in this case, a refrigerant passage for communicating between the second back pressure chamber (S2) and the intermediate pressure chamber (V) should be additionally provided, and an oil passage for supplying oil to the oldham ring 35 located in the second back pressure chamber (S2) should be additionally provided As a result, a number of paths increases to complicate the processing. Therefore, in order to reduce the number of paths by integrating the refrigerant passage with the oil passage, it may be preferable to communicate the oil supply passage 50*a* with the second back pressure chamber (S2) and communicate the second back pressure chamber (S2) with the intermediate pressure chamber (V).

To this end, the first oil feeding path 371 is formed with a first orbiting path portion 371*a* formed up to the middle in the thickness direction from a lower surface of the second end plate portion 331, and a second orbiting path portion 371*b* formed toward an outer circumferential surface of the second end plate portion 331 from the first orbiting path portion 371*a*, and a third orbiting path portion 371*c* penetrating toward an upper surface of the second end plate portion 331 from the second orbiting path portion 371*b*.

Furthermore, the first orbiting path portion 371*a* is formed at a position belonging to the first back pressure chamber (S1) and the third orbiting path portion 371*c* is formed at a position belonging to the second back pressure chamber (S2). Furthermore, a pressure-reducing rod 375 is inserted into the second oil feeding path portion 371*b* to reduce the pressure of oil moving from the first back pressure chamber (S1) to the second back pressure chamber (S2) through the first oil feeding path 371. As a result, a cross-sectional area of the second orbiting path portion 371*b* excluding the pressure-reducing rod 375 is formed to be smaller than the first orbiting path portion 371*a* or the third orbiting path portion 371*c*.

Here, when an end portion of the third orbiting path portion 371*c* is formed to be located on an inner side of the oldham ring 35, that is, between the oldham ring 35 and the sealing member 36, oil moving through the first oil feeding path 371 is blocked by the oldham ring 35 not to efficiently move to the second back pressure chamber (S2). Therefore, in this case, a fourth orbiting path portion 371*d* may be formed from an end portion of the third orbiting path portion 371*c* toward an outer circumferential surface of the second end plate portion 331. The fourth orbiting path portion 371*d* may be formed as a groove on an upper surface of the second end plate portion 331 or formed as a hole inside the second end plate portion 331 as shown in FIG. 4.

The second oil feeding path 372 is formed with a first fixed path portion 372*a* in a thickness direction on an upper surface of the second sidewall portion 322, a second fixed path portion 372*a* in a radial direction from the first fixed path portion 372*a*, and a third fixed path portion 372*c* communicating with the intermediate pressure chamber (V) from the second fixed path portion 372*b*.

Reference numeral 70 in the drawing is an accumulator.

The foregoing lower compression scroll compressor according to this embodiment will be operated as follows.

In other words, when power is applied to the electric motor unit 20, a rotational force is generated to the rotor 21 and the rotation shaft 50 to rotate, and as the rotation shaft 50 rotates, the orbiting scroll 33 eccentrically coupled to the rotation shaft 50 performs an orbiting motion by the oldham ring 35.

Then, refrigerant supplied from the outside of the casing 10 through the refrigerant suction pipe 15 flows into the compression chamber (V), and the refrigerant is compressed and discharged to an inner space of the discharge cover 34 through the discharge ports 325*a*, 325*b* as the volume of the compression chamber (V) is reduced by the orbiting motion of the orbiting scroll 33.

Then, the refrigerant discharged to the inner space of the discharge cover 34 is circulate in the inner space of the discharge cover 34 and moved to a space between the frame 31 and the stator 21 after reducing noise, and the refrigerant is moved to the upper space of the electric motor unit 20 through a gap between the stator 21 and the rotor 22.

Then, after oil is separated from refrigerant in the upper space of the electric motor unit 20, a series of processes of discharging the refrigerant to an outside of the casing 10 through the refrigerant discharge pipe 16 while collecting the oil into the lower space 10*c* which is an oil storage space of the casing 10 through a passage between an inner circumferential surface of the casing 10 and the stator 21 and a passage between an inner circumferential surface of the casing 10 and an outer circumferential surface of the compression unit 30 are repeated.

At this time, oil in the lower space 10*c* is sucked up through the oil supply passage 50*a* of the rotation shaft 50, and the oil lubricate the first bearing portion 51, the second bearing portion 52, and the eccentric portion 53, respectively, through the respective oil feeding holes 511, 521, 531 and oil feeding grooves 512, 522, 532.

The oil lubricating the first bearing portion 51 through the first oil feeding hole 511 and the first oil feeding groove 512 is collected into the first connection groove 51 between the first bearing portion 51 and the eccentric portion 53, and the oil flows into the first back pressure chamber (S1). The oil almost forms a discharge pressure, and thus the pressure of the first back pressure chamber (S1) almost also forms the discharge pressure. Therefore, an center portion side of the second scroll 33 may be supported in an axial direction by the discharge pressure.

On the other hand, the oil of the first back pressure chamber (S1) is moved to the second back pressure chamber (S2) through the first oil feeding path 371 due to a pressure difference from the second back pressure chamber (S2). At this time, the pressure-reducing rod 375 is provided in the second orbiting path portion 371*b* constituting the first oil feeding path 371, and thus a pressure of the oil moving toward the second back pressure chamber (S2) is reduced to an intermediate pressure.

Furthermore, the oil moving to the second back pressure chamber (intermediate pressure space) (S2) moves to the intermediate pressure chamber (V) through the oil feeding path 372 due to a pressure difference from the intermediate pressure chamber (V) while at the same time supporting an edge portion of the second scroll 33. However, when the pressure of the intermediate pressure chamber (V) is higher than that of the second back pressure chamber (S2) during the operation of the compressor, refrigerant moves to the second back pressure chamber (S2) through the second oil feeding path 372 from the intermediate pressure chamber (V). In other words, the second oil feeding path 372 serves as a path for moving refrigerant and oil in an intersecting manner due to a difference between the pressure of the second back pressure chamber (S2) and the pressure of the intermediate pressure chamber (V).

Meanwhile, as described above, the air conditioner according to the embodiment of the present disclosure is provided with a cooling cycle device capable of performing cooling or heating using a phase change of circulating refrigerant.

The cooling cycle device includes a compressor, a condensing unit connected to a discharge side of the compressor to condense compressed refrigerant, an expansion unit configured to expand the refrigerant condensed in the condensing unit, an evaporation unit connected to a suction side of the compressor to evaporate the refrigerant expanded in the expansion unit, and an injection unit provided between the expansion unit and the evaporation unit to inject part of the refrigerant expanded in the expansion unit into the intermediate pressure chamber of the compressor other than the evaporation unit. The cooling cycle device will be described again later while describing the operation of an air conditioner, and first of all, the injection unit in the lower compression scroll compressor applied to the cooling cycle device of this embodiment will be described.

Figure 5:
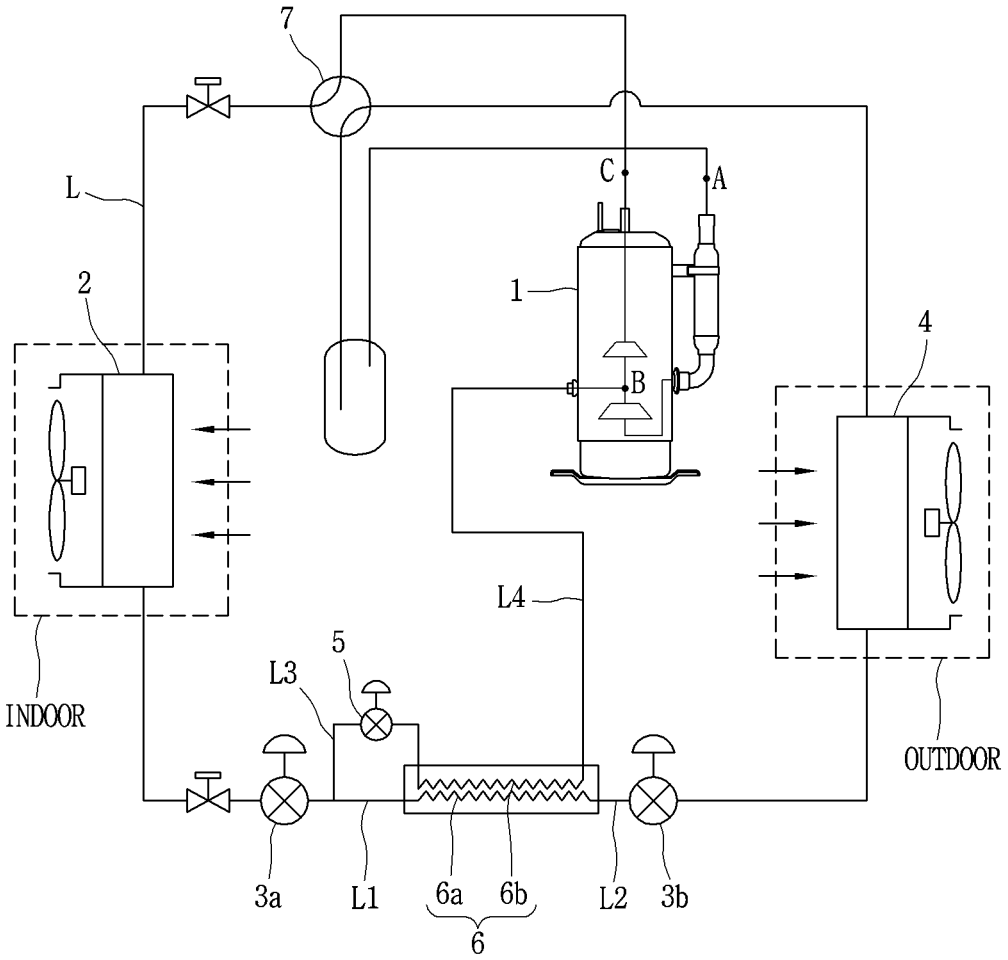
FIG. 5 is a system diagram showing a heating operation in an air conditioner according to an embodiment of the present disclosure.

According to the present embodiment, as shown in FIG. 1, due to the characteristics of the lower compression scroll compressor, the compression unit 30 is located at a lower half of the casing 10, that is, the cylindrical shell 11, and above all, the first scroll 31 constituting the compression chamber constitutes a lower portion of the compression unit 30. Accordingly, as shown in FIG. 5, an injection pipe connection hole 11*a* is formed around a lower end of the cylindrical shell 11 to allow an injection pipe (more particularly, a connection pipe) (L4) which will be described later to be inserted and coupled thereto, and the intermediate member 11*b* may be coupled to the injection pipe connection hole 11*a* for welding between the injection pipe (L4) and the cylindrical shell 11. As a result, even when the injection pipe (L4) communicates with an inner space of the casing 10 having a high pressure, it may be possible to suppress refrigerant from leaking.

Furthermore, an injection passage 391 is formed in the first end plate portion 321 of the first scroll 32 to communicate with an injection unit which will be described later through an injection connection hole 11*a* of the cylindrical shell 11. The injection passage 391 includes a first passage 391*a* formed in a radial direction from an outer circumferential surface of the first end plate portion 321 toward the center and a second passage 391*b* penetrated from a center-side end portion of the first passage 391*a* toward the intermediate pressure chamber (Vm).

Here, an outlet end of the second passage 391*b* may be formed to communicate with the suction chamber (Vs), but in this case, refrigerant injected through the injection passage 391 (hereinafter, referred to as injection refrigerant) may have a relatively higher pressure than that of refrigerant being sucked (hereinafter, referred to as suction refrigerant), thereby causing suction loss. Therefore, the outlet end of the second passage 391*b* may be preferably communicated with the intermediate pressure chamber (Vm) having a higher pressure than the suction chamber (Vs).

Furthermore, though the outlet end of the second passage 391*b* is preferably formed around the discharge port to reduce compression loss, the outlet end of the second passage 391*b* may be more preferably formed to communicate with the intermediate pressure chamber (Vm) typically having a lower pressure than the bypass hole 381. However, when a plurality of bypass holes 381 are formed along the path of the compression chamber (V), the outlet end of the second passage 391*b* may not necessarily communicate with the intermediate pressure chamber having a lower pressure than the bypass hole 381. In other words, in this case, the second passage 391*b* may communicate with the intermediate pressure chamber (Vm) between the bypass holes 381.

Meanwhile, a cooling cycle device of an air conditioner to which a lower compression scroll compressor having the above-described injection unit is applied is as follows.

In other words, as described above, the cooling cycle device includes a compression unit, a condensing unit, an expansion unit, an evaporation unit, and an injection unit. Here, the compression unit may be configured with a compressor 1, the condensing unit with a condenser 2 and a condensing fan 2*a*, the expansion unit with a first expansion valve 3*a* and a second expansion valve 3*b*, the evaporation unit with an evaporator 4, and the injection unit with an injection expansion valve 5 and an injection heat exchanger 6, respectively.

Furthermore, the compressor 1, the condenser 2, the first expansion valve 3*a* and the second expansion valve 3*b*, the evaporator 4, the injection expansion valve 5, and the injection heat exchanger 6 are connected to the refrigerant pipe (L) for guiding the flow of refrigerant to form a closed loop, and among them, the injection expansion valve 5 and the injection heat exchanger 6 are connected to the refrigerant pipe (L) through the bypass pipe (L3) and the injection pipe (L4) to form an injection cycle.

Here, the injection expansion valve 5 may be configured with a valve capable of adjusting a degree of expansion by controlling its opening degree.

In addition, between a discharge side of the compressor 1 and an inlet of the condenser 2, a refrigerant switching valve 7 for switching a flow direction of the refrigerant is provided. Accordingly, when the air conditioner is in a cooling operation, the outdoor heat exchanger may function as a condenser and the indoor heat exchanger as an evaporator. On the contrary, when the air conditioner is in a heating operation, the indoor heat exchanger may function as a condenser and the outdoor heat exchanger as an evaporator.

As described above, the compressor 1 is provided with a lower compression type axial through scroll compressor in which the compression unit 30 is located below the electric motor unit 20 while the rotation shaft 50 is coupled through the second scroll 33 constituting an orbiting scroll. The compressor has been described in detail above.

The condenser 2, the first expansion valve 3*a* and the second expansion valve 3*b*, and the evaporator 4 are generally known constructions, and a detailed description thereof will be omitted. However, the injection expansion valve 5 may be configured with a valve capable of adjusting an opening amount to control a flow amount of refrigerant, and the injection heat exchanger 6 may be a double pipe heat exchanger having an outer pipe and an inner pipe.

Figure 6:
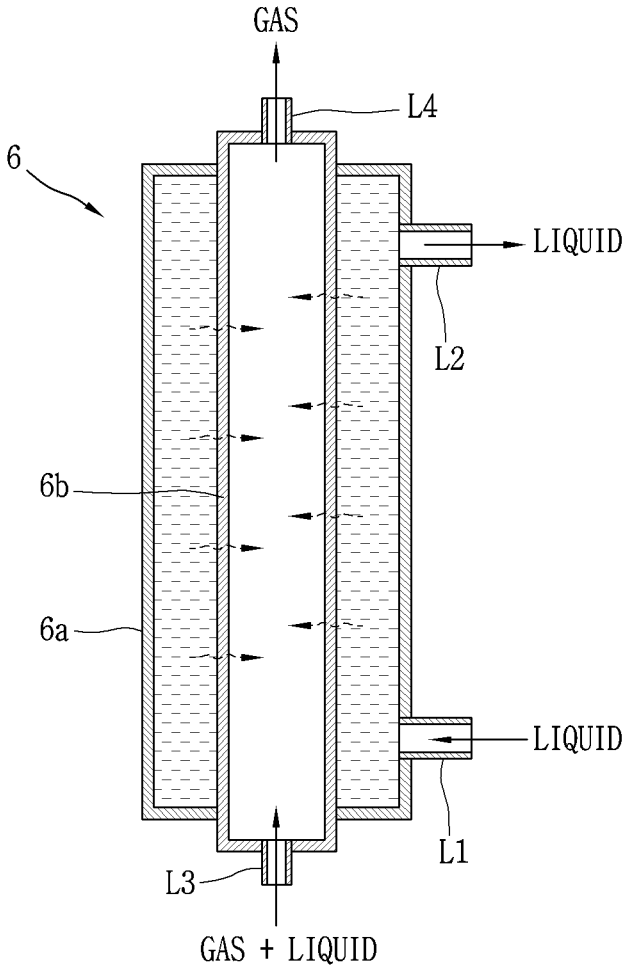
FIG. 6 is a cross-sectional view showing an embodiment of an internal heat exchanger in the air conditioner according to FIG. 5.

As shown in FIG. 6, an inlet of an outer pipe 6*a* is connected to an outlet of the first expansion valve 3*a* through the first refrigerant pipe (L1), and an outlet of the outer pipe 6*a* is connected to an inlet of the second expansion valve 3*b* and the second refrigerant pipe (L2).

Furthermore, an inlet of an inner pipe 6*b* of the injection heat exchanger 6 is connected to a bypass pipe (L3) branched from the first refrigerant pipe (L1), and an outlet of the inner pipe 6*b* may be connected to an injection passage 391 of the compressor 1, which will be described later, through an injection pipe (L4).

In addition, the injection expansion valve 5 described above may be connected and provided at the middle of the bypass pipe (L3).

Thus, liquid refrigerant that has been primarily expanded while passing through the first expansion valve 3*a* flows into the outer pipe 6*a*, and the refrigerant is bypassed to the branched bypass pipe (L3) to pass through the injection expansion valve 5 while moving to the expansion valve 3*b*. The refrigerant passing through the injection expansion valve 5 is secondarily expanded in the injection expansion valve 5 to a state in which the liquid refrigerant and the gas refrigerant are mixed.

The liquid refrigerant and the gas refrigerant that have passed through the injection expansion valve 5 flow into the inner pipe 6*b* of the injection heat exchanger 6, and the liquid refrigerant and the gas refrigerant flowing into the inner pipe 6*b* exchange heat with the primarily expanded high-temperature refrigerant of the outer pipe 6*a* to absorb heat from the refrigerant of the outer pipe 6*a* to be converted into gas refrigerant, and the secondarily expanded gas refrigerant is guided to the injection passage 391 through the injection pipe (L4), which will be described later, and injected into the intermediate pressure chamber (Vm).

Figure 7:
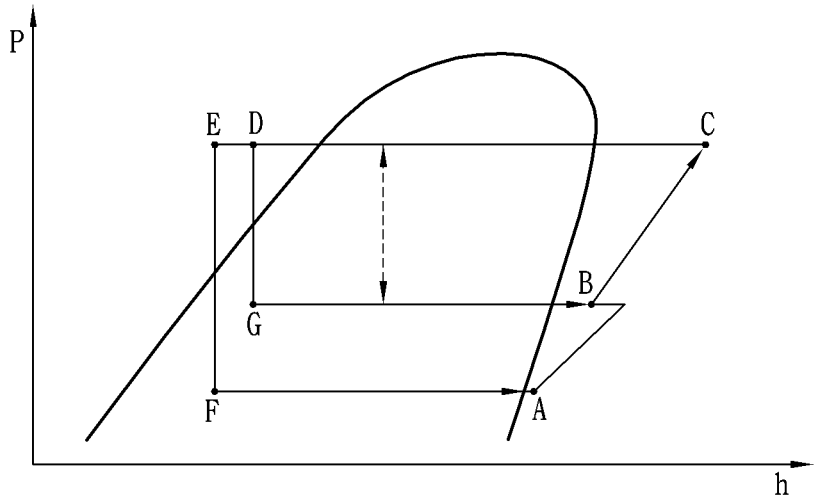
FIG. 7 is a P-H diagram showing a refrigerant physical property change during the operation of the air conditioner according to FIG. 5.

A pressure-enthalpy diagram (P-H diagram) of a refrigerant system circulating through the air conditioner will be described with reference to FIGS. 5 and 7. This is based on a heating operation, and thus the indoor heat exchanger operates as the condenser 2 and the outdoor heat exchanger as the evaporator 4.

In other words, refrigerant (state A) sucked into the compressor 1 is compressed by the compressor 1 and mixed with refrigerant injected into the compressor 1 through the injection passage (L4). The mixed refrigerant indicates the state of B. The process in which refrigerant is compressed from the state A to the state B is referred to as a "one- stage compression."

The refrigerant in the state B is compressed again, indicating the C state. The process in which the refrigerant is compressed from the state B to the state C is referred to as a "two-stage compression." Then, the refrigerant indicates the state of D when the refrigerant is discharged in the state of C to flow into the indoor heat exchanger serving as the condenser 2, and discharged from the condenser 2.

The refrigerant that has passed through the condenser 2 is "primarily expanded" through the first expansion valve 3*a* to become a state D, and the primarily expanded refrigerant passes through the outer pipe 6*a* of the injection heat exchanger 6 and then most of the refrigerant (circulating refrigerant) moves in a direction toward the second expansion valve 3*b* while part of the refrigerant (injection refrigerant) is bypassed to the bypass pipe (L3) while opening the injection expansion valve 5. At this time, the circulating refrigerant is heat-exchanged with the injection refrigerant passing through the inner pipe 6*b* of the injection heat exchanger 6 while passing through the outer pipe 6*a* of the injection heat exchanger 6 to be re-condensed to a state E, which is referred to as "secondary condensation." On the contrary, the injection refrigerant is "injection-expanded" to become a state G, and then "injection-evaporated" while passing through the inner pipe 6*b* of the injection heat exchanger 6 to secure a degree of superheat.

A series of processes in which the circulating refrigerant that has passed through the second expansion valve 3*b* passes through the evaporator 4 to become a state A and is sucked into the suction chamber (Vs) of the compressor 1 through the suction pipe 15 while the injection refrigerant that has passed through the injection heat exchanger is injected into the intermediate pressure chamber (Vm) of the compressor through the injection pipe (L4) are repeated.

In the scroll compressor according to the present embodiment as described above, a series of processes in which refrigerant is guided from the cooling cycle to the suction groove 324 of the first scroll 32 through the suction pipe 15, and the refrigerant flows into the intermediate pressure chamber (Vm) by passing through the suction chamber (Vs) through the suction groove, and compressed while moving toward the center between the second scroll 33 and the first scroll 32 by an orbiting motion of the second scroll 33 and then discharged to an inner space of the discharge cover 34 through the discharge port 325 of the first scroll 32 in the discharge chamber (Vd), and the refrigerant is discharged to the intermediate space 10*a* of the casing 10 through the first refrigerant passage (PG1) and then moved to the upper space 10*b* through the second refrigerant passage (PG2) and then discharged to the refrigeration cycle through the discharge pipe 16 are repeated.

At this time, the gas refrigerant discharged from the compressor 1 is converted into liquid refrigerant after passing through the condenser 2 to pass through the first expansion valve 3*a*, and the liquid refrigerant that has passed through the first expansion valve 3*a* is passed through the injection heat exchanger (supercooling device) 6 and then at least partially passed to the bypass pipe (L3), and the injection refrigerant is passed again through the injection heat exchanger 6 through the injection expansion valve 5 and injected into the intermediate pressure chamber (Vm) of the compressor 1 through the injection pipe (L4).

However, the injection refrigerant expands while passing through the injection expansion valve 5 to become a state in which the low-temperature low-pressure liquid refrigerant and the gas refrigerant are mixed together, and the injection refrigerant absorbs heat from the circulating refrigerant moving in a direction of the evaporator through the outer pipe 6*a* of the injection heat exchanger 6 while passing through the inner pipe 6*b* of the injection heat exchanger 6. Accordingly, the injection refrigerant is converted into the gas refrigerant to move to the injection passage 391 through the injection pipe (L4) while the circulating refrigerant moves to the evaporator 4 in a state of being supercooled to a lower temperature.

Here, the injection refrigerant flowing into the injection passage 391 moves along the first passage 391*a* and the second passage 391*b* of the first scroll 32 and flows into the intermediate pressure chamber (Vm). At this time, as the compression chamber (V) is formed on an upper surface of the first scroll 32, the first scroll itself is heated by compression heat. Moreover, the first scroll 32 is also heated by the refrigerant discharged into the inner space of the discharge cover 34, and the first scroll 32 is heated to a high temperature as a whole. Accordingly, as the injection refrigerant is heat-exchanged with the first scroll 32 in the process of passing through the first passage 391*a* and the second passage 391*b* of the first scroll 32 and heated by heat conduction, a degree of superheat with respect to the injection refrigerant may be increased. thereby reducing the possibility that the liquid refrigerant flows into the compression chamber.

Meanwhile, a scroll compressor according to another embodiment of the present disclosure and an air conditioner having the scroll compressor will be described as follows.

In other words, the foregoing embodiment relates to a case where the injection unit is configured with one injection unit, but the present embodiment relates to a case where the injection unit is configured with two injection units, namely, a first injection unit and a second injection unit. Of course, the injection unit may be configured with two or more, and even in this case, it is substantially similar to a case of two to be described in the following.

Furthermore, the basic configuration of a compressor according to the present embodiment is the same as the foregoing embodiment. However, as shown in FIGS. 8 and 9, in the compressor according to the present embodiment, the first injection passage 395 and the second injection passage 396 are formed in the first end plate portion 321 of the first scroll 32.

Here, the first injection passage 395 and the second injection passage 396 are configured with first passages 395*a*, 396*a* and second passages 395*b*, 396*b*, respectively, and an outlet of the second passage (first injection-side second passage) 395*b* of the first injection passage 395 and an outlet of the second passage (second injection-side second passage) 396*b* of the second injection passage 396 are communicated with different intermediate pressure chambers (Vm1, Vm2), respectively.

Figure 8:
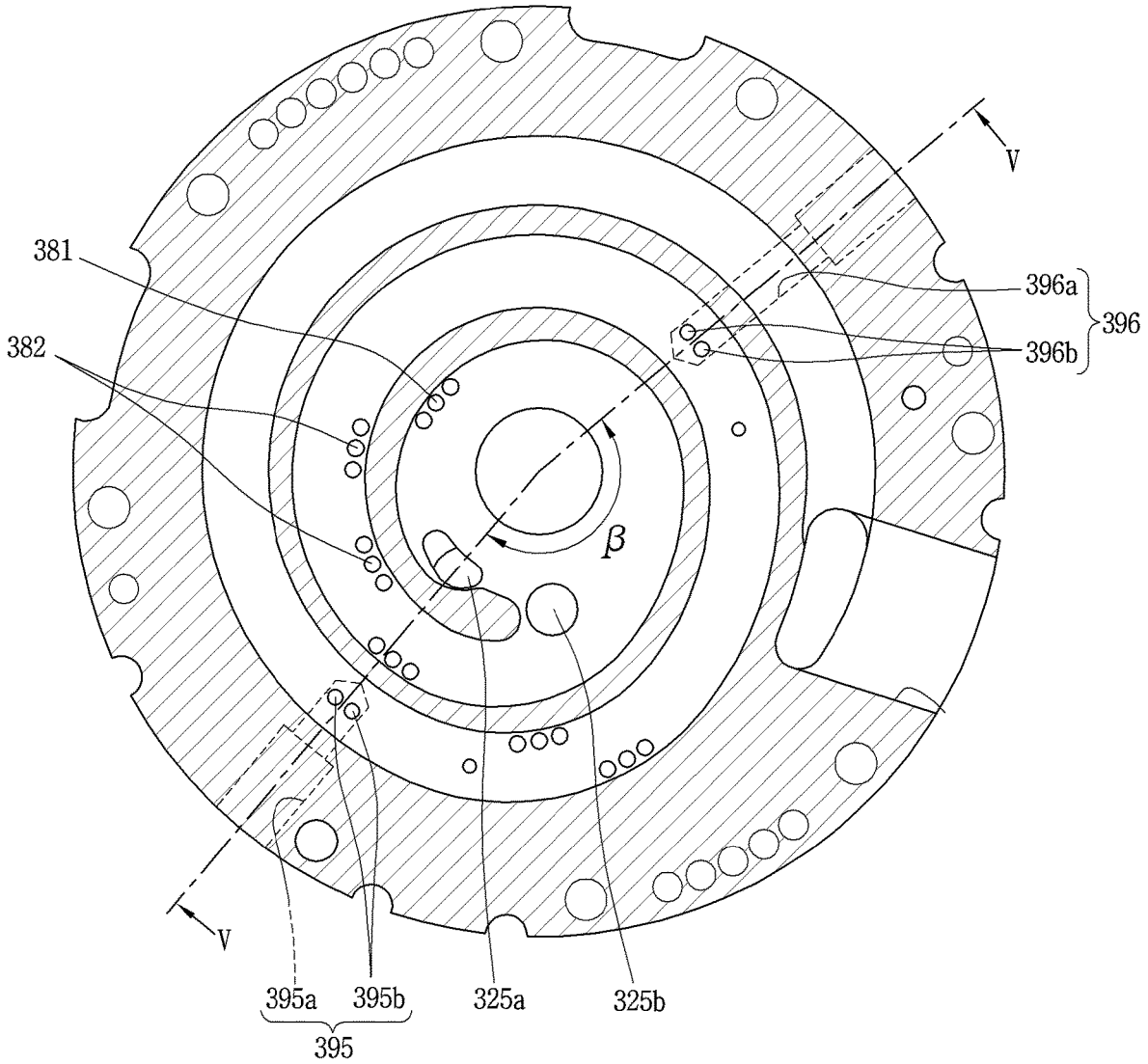
FIG. 8 is a plan view showing a first scroll for explaining a compression unit having a plurality of injection units in a lower compression scroll compressor according to the present disclosure.
Figure 9:
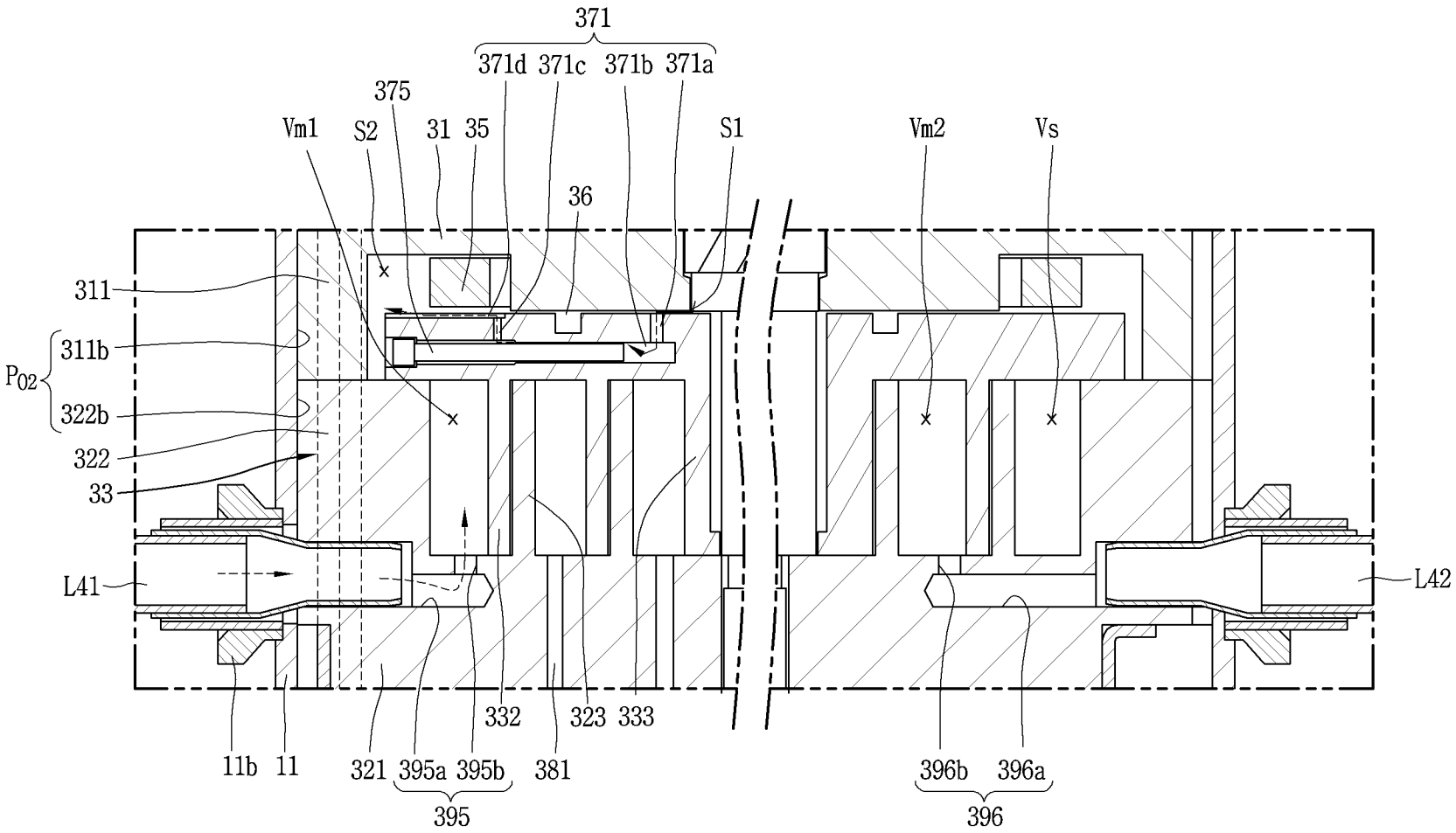
FIG. 9 is a cross-sectional view taken along line "V-V" in FIG. 8.

In this case, as shown in FIG. 8, the outlet of the first injection-side second passage 395*b* may be formed to be positioned prior to completing a suction stroke, and the outlet of the second injection-side second flow path 396*b* subsequent to completing the suction stroke, and more precisely, a rotation angle (β) between the first injection-side second passage 395*b* and the second injection-side second passage 396*b* may be formed within a range of about 150 to 200 degrees in the compression advancing direction of the refrigerant, and preferably formed to have a phase difference of about 170°.

Figure 10:
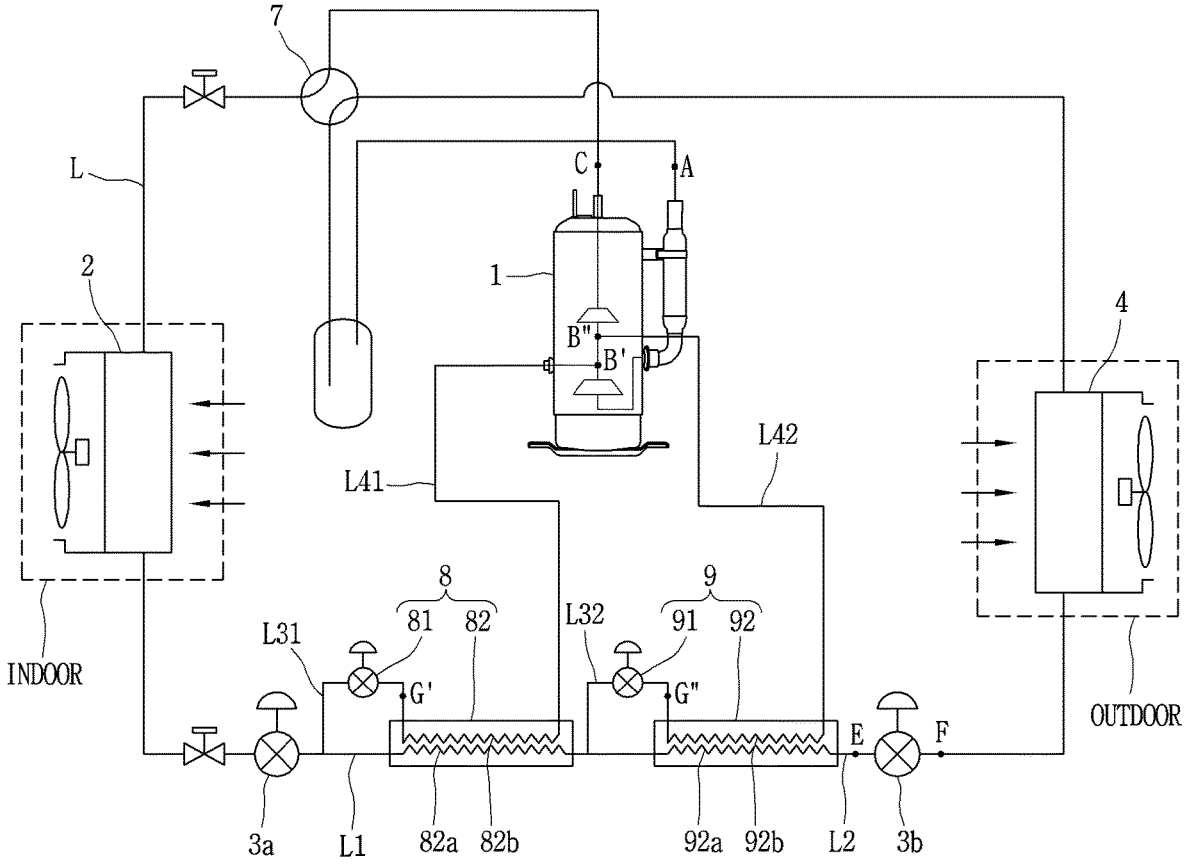
FIG. 10 is a system diagram showing a heating operation in an air conditioner to which the compressor according to the embodiment of FIG. 8 is applied.
Figure 11:
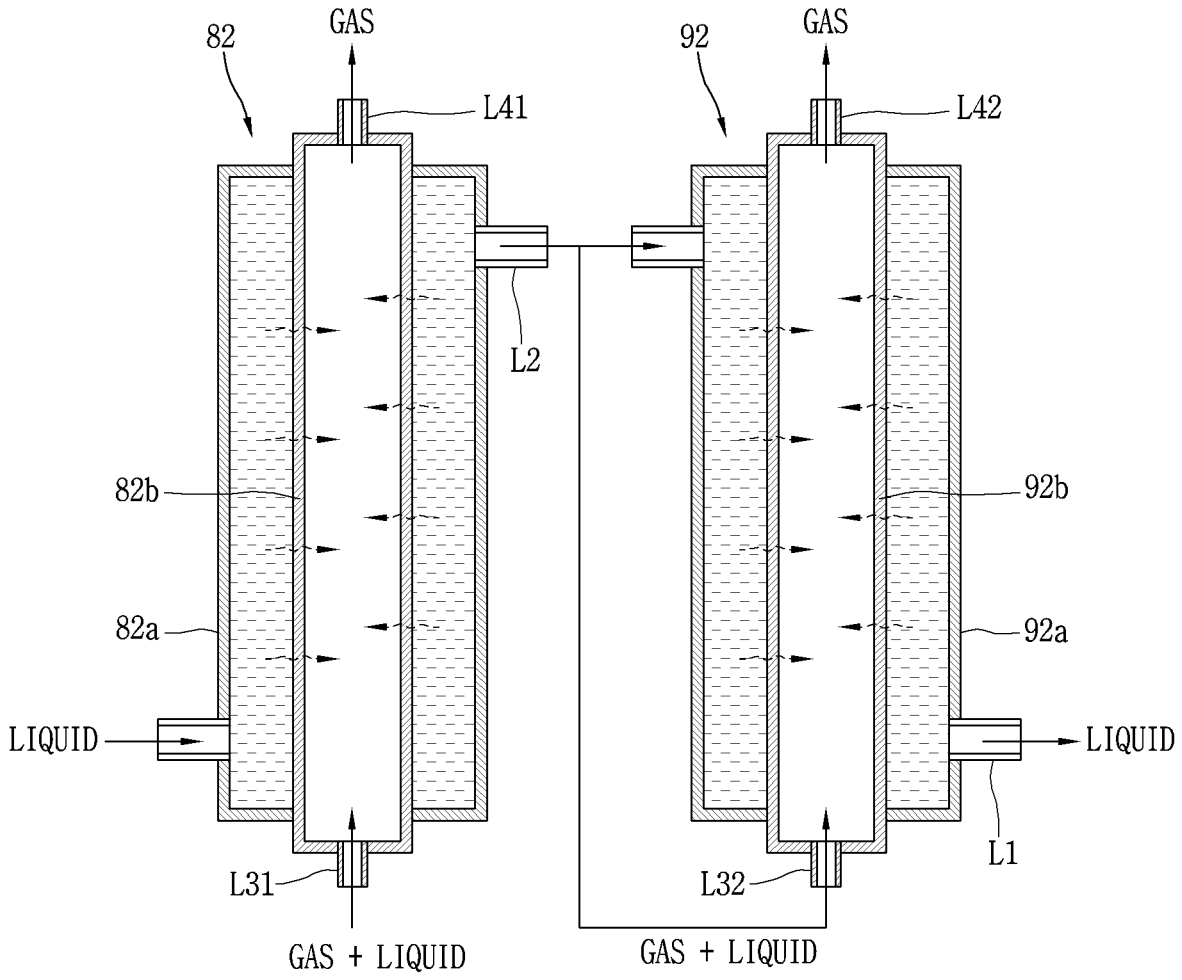
FIG. 11 is a cross-sectional view showing an embodiment of an internal heat exchanger in the air conditioner according to FIG. 10.

In addition, the basic configuration of the first injection unit and the second injection unit is similar to the basic configuration of the above-described injection unit. For example, as shown in FIG. 10, the first injection unit 8 includes a first injection expansion valve 81 and a first injection heat exchanger 82, and the second injection unit 9 includes a second injection expansion valve 91 and a second injection heat exchanger 92. The first injection heat exchanger 82 and the second injection heat exchanger 92 may be formed in a double pipe structure such as the above-described injection heat exchanger 6.

Furthermore, a first injection pipe (L41) connected to the first injection heat exchanger 82 may be connected to the first injection passage 395, and a second injection pipe (L42) connected to the second injection heat exchanger 92 may be connected to the second injection passage 396.

Here, in the condenser 2, the first injection unit 8 is located on an upstream side of the second injection unit 9, that is, on a side of the condenser 2, with respect to the direction of the evaporator. Accordingly, the first expansion valve 3*a* is connected to an upstream side of the first injection unit 8, and the second expansion valve 3*b* is connected to a downstream side of the second injection unit 9, respectively.

Moreover, the first injection pipe (L41) is connected to an inner pipe (hereinafter, first inner pipe) 82*b* of the first injection heat exchanger 82 and an outer pipe (hereinafter, first outer pipe) 82*a* constituting the first injection heat exchanger 82 together with the first inner pipe 82*b* is connected to an outlet of the first injection expansion valve 81 by the first bypass pipe (L31).

Besides, the second injection pipe (L42) is connected to an inner pipe (hereinafter, second inner pipe) 92*b* of the second injection heat exchanger 92 and an outer pipe (hereinafter, second outer pipe) 92*a* constituting the second injection heat exchanger 92 together with the second inner pipe 92*b* is connected to an outlet of the second injection expansion valve 91 by the second bypass pipe (L32). The inlet of the second injection expansion valve 91 is connected to an outlet of the first outer pipe 82*a*.

The operation of the scroll compressor and the air conditioner having the scroll compressor according to the present embodiment as described above is substantially similar to the foregoing embodiment. In this embodiment, however, a plurality of injection units are provided, and thus refrigerant is first injected through the first injection unit 8 communicating with the upstream side with respect to the compression advancing direction of the refrigerant, and refrigerant is injected later through the second injection unit 9 relatively communicating with the downstream.

Figure 12:
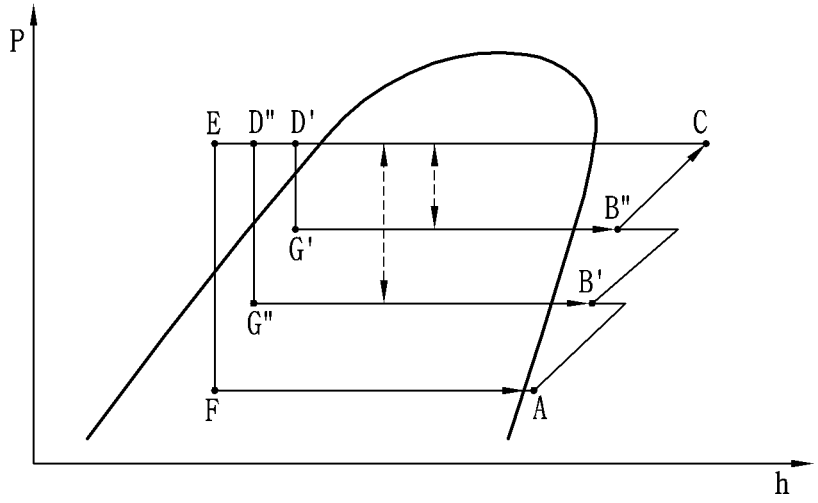
FIG. 12 is a P-H diagram showing a refrigerant physical property change during the operation of the air conditioner according to FIG. 10.

As a result, the compression performance may be further improved as two injections proceed at a constant interval in one cycle in which the refrigerant is sucked and discharged. The effect of this may be confirmed through the P-H diagram illustrated in FIG. 12. This will be replaced with the description of the P-H diagram in the foregoing embodiment.

The foregoing description is merely embodiments for implementing a scroll compression compressor according to the present disclosure, and the present disclosure may not be necessarily limited to the foregoing embodiments, and it will be understood by those skilled in the art that various modifications can be made without departing from the gist of the invention as defined in the following claims.

What is claimed is:

1. A scroll compressor, comprising:

a casing defining an inner space therein that is communicably coupled to a discharge pipe configured to be connected to an inlet side of a condenser of a cooling cycle device;

a drive motor provided in the inner space of the casing;

a rotation shaft coupled to the drive motor;

a frame provided at a lower side of the drive motor;

a first scroll provided at a lower side of the frame, with a first side of the first scroll formed with a first wrap; and a second scroll formed with a second wrap configured to engage with the first wrap, with the rotation shaft eccentrically coupled to the second wrap and configured to, as the rotation shaft rotates, move the second wrap along an orbital motion around the shaft with respect to a fixed position of the first wrap to form a compression chamber between the first scroll and the second scroll, with the compression chamber being connected to an outlet side of an evaporator of the cooling cycle, wherein the compression chamber is configured to be communicable, through an opening in the first scroll, with an injection unit having a first end that is configured to branch from a refrigerant pipe arranged between the condenser and the evaporator.

2. The scroll compressor of claim 1, wherein the injection unit comprises:

an injection pipe having a first end that is configured to branch from a refrigerant pipe arranged between the condenser and the evaporator, and having a second end that is configured to penetrate and couple to the casing; and an injection passage configured to be connected to the second end of the injection pipe and to communicate with the compression chamber through an inner region of the first scroll.

3. The scroll compressor of claim 2, wherein the injection passage comprises:

a first passage that is directed from an outer circumferential surface of the first scroll toward a center of the first scroll; and a second passage having a first end that is connected to the first passage and a second end that is communicable with the compression chamber that is formed between the first scroll and the second scroll.

4. The scroll compressor of claim 1, wherein the compression chamber is a first compression chamber among a plurality of compression chambers formed between the first scroll and the second scroll as the rotation shaft moves the second wrap along the orbital motion with respect to the first wrap, the plurality of compression chambers comprising a second compression chamber, wherein the first scroll has defined therein a bypass hole configured to partially discharge refrigerant that is compressed in the first compression chamber such that the first compression chamber generates a first pressure therein, and wherein an outlet of the injection unit is configured to communicate with the second compression chamber such that the second compression chamber generates therein a second pressure that is lower than the first pressure generated in the first compression chamber.

5. The scroll compressor of claim 1, wherein the compression chamber is a first compression chamber among a plurality of compression chambers formed between the first scroll and the second scroll as the rotation shaft moves the second wrap along the orbital motion with respect to the first wrap, the plurality of compression chambers comprising a second compression chamber, wherein the frame and the second scroll are configured to form a back pressure chamber therebetween, wherein the first scroll comprises an oil feeding path configured to provide communication between the back pressure chamber and the first compression chamber such that the first compression chamber generates a first pressure therein, and wherein an outlet of the injection unit is configured to communicate with the second compression chamber such that the second compression chamber generates therein a second pressure that is lower than the first pressure generated in the first compression chamber.

6. The scroll compressor of claim 1, wherein a suction chamber is formed in the compression chamber as the rotation shaft moves the second wrap along the orbital motion with respect to the first wrap, and wherein an outlet of the injection unit is configured to communicate with the suction chamber.

7. The scroll compressor of claim 1, wherein the injection unit comprises a plurality of injection units that are configured to communicate with the compression chamber through a plurality of openings that are defined through the first scroll at different locations along a circumference of the first scroll.

8. The scroll compressor of claim 7, wherein the compression chamber is a first compression chamber among a plurality of compression chambers formed between the first scroll and the second scroll as the rotation shaft moves the second wrap along the orbital motion with respect to the first wrap, the plurality of compression chambers generating different pressures therein, and wherein the plurality of injection units is configured to communicate with the plurality of compression, respectively.

9. The scroll compressor of claim 8, wherein the plurality of injection units comprise a first injection unit and a second injection unit, and wherein the first injection unit is configured to communicate with the first compression chamber prior to completion of refrigerant being sucked into the first compression chamber, and wherein the second injection unit is configured to communicate with a second compression chamber subsequent to completion of refrigerant being sucked into the second compression chamber.

10. The scroll compressor of claim 1, wherein the rotation shaft is eccentrically coupled to the second wrap to overlap therewith in a radial direction.

11. An air conditioner, comprising:

a condensing unit;

a first expansion unit connected to an outlet of the condensing unit;

an injection heat exchange unit connected to an outlet of the first expansion unit;

a second expansion unit connected to an outlet of the injection heat exchange unit;

an evaporation unit connected to an outlet of the second expansion unit; and a compressor having a suction unit connected to an outlet of the evaporation unit, a discharge unit connected to an inlet of the condensing unit, and an injection unit connected to an outlet of the injection connection unit, wherein the compressor comprises a scroll compressor of claim 1.

12. The air conditioner of claim 11, further comprising:

a refrigerant switching unit configured to switch a flow direction of refrigerant between the discharge unit and the condensing unit of the compressor.

13. The air conditioner of claim 11, wherein the injection heat exchange unit comprises:

an injection expansion unit; and an internal heat exchange unit configured to exchange heat between a first portion of the refrigerant that has passed through the injection expansion unit and a second portion of the refrigerant that has passed through the first expansion unit.

14. The air conditioner of claim 13, wherein the injection heat exchange unit comprises a plurality of injection heat exchange units connected in series, and wherein the plurality of injection heat exchange units comprises the injection expansion unit and the internal heat exchange unit, respectively.

15. The air conditioner of claim 14, wherein the compression chamber is a first compression chamber among a plurality of compression chambers formed between the first scroll and the second scroll as the rotation shaft moves the second wrap along the orbital motion with respect to the first wrap, the plurality of compression chambers generating different pressures therein, and wherein the plurality of injection heat exchange units are configured to communicate with the plurality of compression chambers.

* * * * *